US006868645B2

(12) United States Patent
Hauser

(10) Patent No.: US 6,868,645 B2
(45) Date of Patent: Mar. 22, 2005

(54) 3-DIMENSIONAL MAT-SYSTEM FOR POSITIONING, STAGGERED ARRANGEMENT AND VARIATION OF AGGREGATE IN CEMENT-BONDED STRUCTURES

(76) Inventor: Stephan Hauser, Ander Steinkaute 15b, Langen (DE), 63225

( * ) Notice: Subject to any disclaimer, the term of this patent is extended or adjusted under 35 U.S.C. 154(b) by 0 days.

(21) Appl. No.: 09/965,050

(22) Filed: Sep. 27, 2001

(65) Prior Publication Data

US 2002/0062619 A1 May 30, 2002

Related U.S. Application Data

(63) Continuation of application No. PCT/IB00/01369, filed on Sep. 27, 2000, now abandoned.

(30) Foreign Application Priority Data

Sep. 27, 1999 (CH) ..... 1788/99

(51) Int. Cl.[7] ..... E04C 2/32

(52) U.S. Cl. ..... 52/742.14; 52/649.1; 52/630; 52/309.16; 52/742.14; 52/301

(58) Field of Search ..... 52/601, 649.1, 52/630, 309.16, 309.17, 454, 742.14

(56) References Cited

U.S. PATENT DOCUMENTS

| | | | | | |
|---|---|---|---|---|---|
| 553,305 | A | * | 1/1896 | Fordyce | 52/336 |
| 1,335,780 | A | * | 4/1920 | Barton | 52/253 |
| 4,578,301 | A | * | 3/1986 | Currie et al. | 428/109 |
| 5,079,890 | A | * | 1/1992 | Kubik et al. | 52/649.1 |
| 5,251,414 | A | * | 10/1993 | Duke | 52/309.16 |

FOREIGN PATENT DOCUMENTS

| | | | |
|---|---|---|---|
| AU | 3406899 | A | 9/1999 |
| DE | 198 08 078 | A | 9/1999 |
| DE | 199 03 304 | A1 | 8/2000 |
| GB | 2 196 660 | A | 5/1988 |
| GB | 2 234 276 | A | 1/1991 |
| GB | 2 234 277 | A | 1/1991 |
| WO | WO 99 42678 | A | 8/1999 |

OTHER PUBLICATIONS

Hauser et al., "Ducon, ein innovatiever hochleistungsbeton", Beton—und stahlbetonbau, vol. 94 (1999) No. Heft.2, Feb. 22, 1999 pp. 66–75.

Hauser et al., "Ducon, ein innovatiever hochleistungsbeton", Beton—und stahlbetonbau, vol. 94 (1999) No. Heft.3, Mar. 19, 1999 pp. 141–145.

* cited by examiner

*Primary Examiner*—Brian E. Glessner
*Assistant Examiner*—Basil Katcheves
(74) *Attorney, Agent, or Firm*—Gudrun E. Huckett

(57) ABSTRACT

This invention refers to the manufacturing of structural and impervious members by slurry-infiltration in a 3-dimensional mat system, which consists of single layers (2). The single layers are preferably meshes. The structural system is a composite material consisting of a 3-dimensional micro reinforcing and sieving mat system bonded in concrete. The aggregate (1) can be precisely positioned horizontally and vertically in the member by variation of the mesh width of the single layers (2). The sieving effect by the variation of the mesh width in vertical direction guarantees a positioning of aggregate by size. By this effect the load capacity, the stiffness and the crack propagation can be controlled and adjusted precisely.

21 Claims, 5 Drawing Sheets

Figure 5:
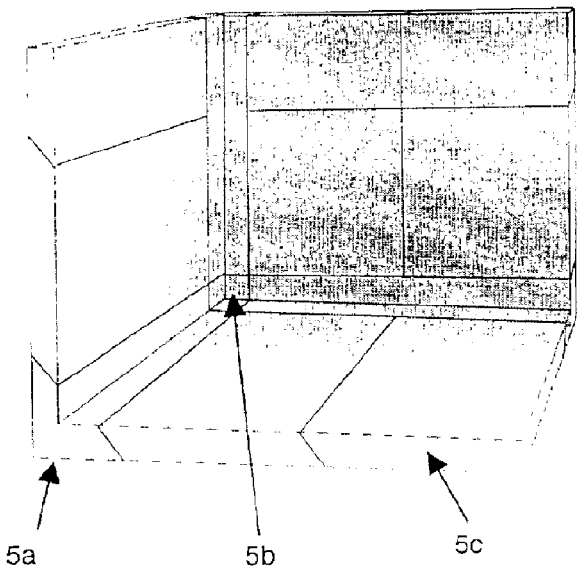

Figures
Fig. 1.1
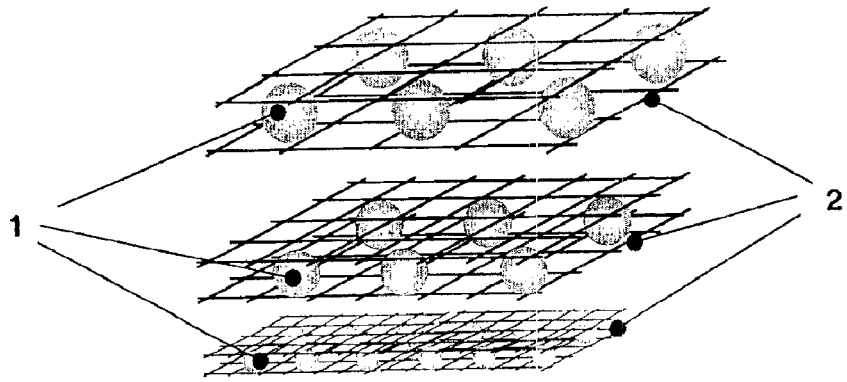
Fig. 1.2
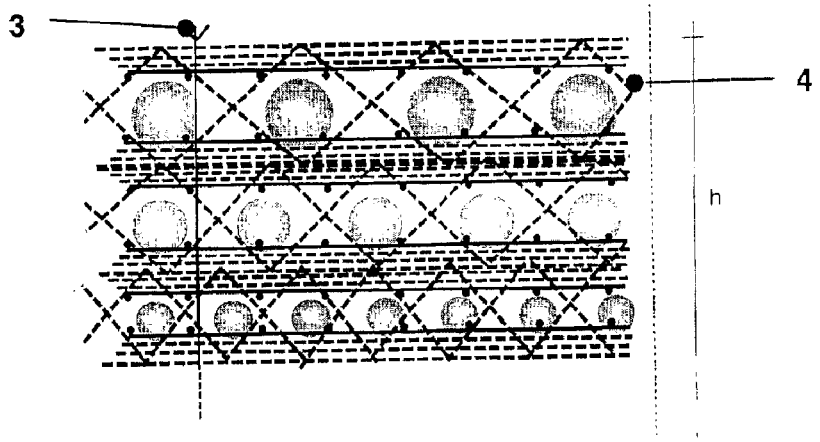
Fig. 2
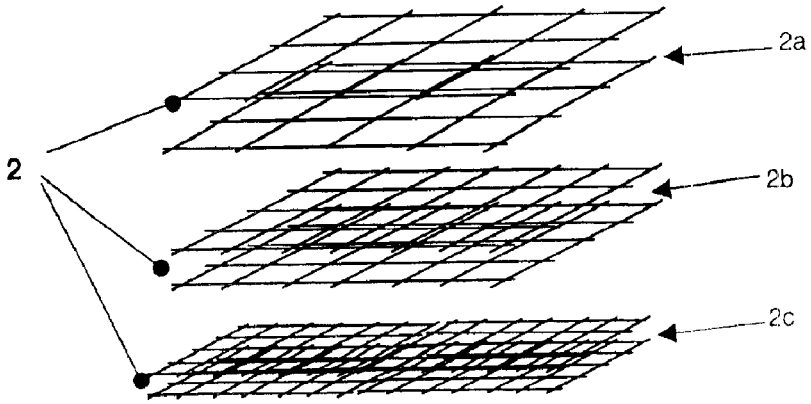

Fig 3
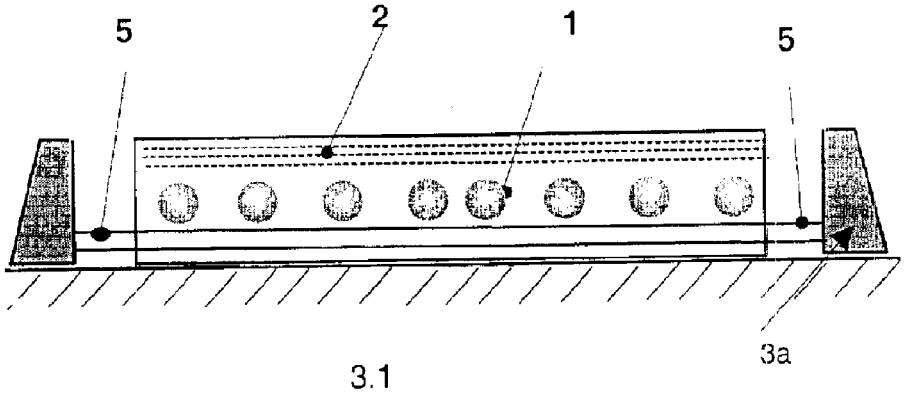
3.1
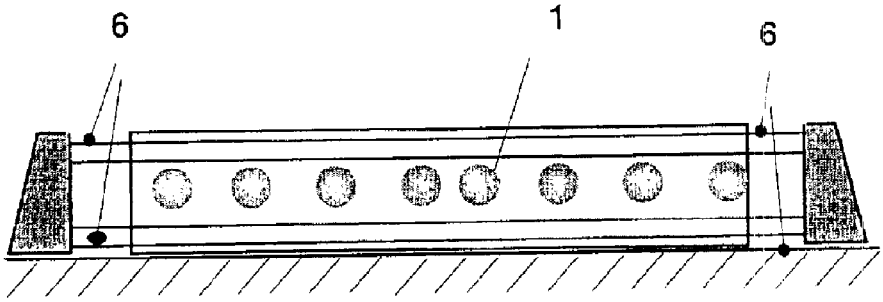
3.2
Fig. 4
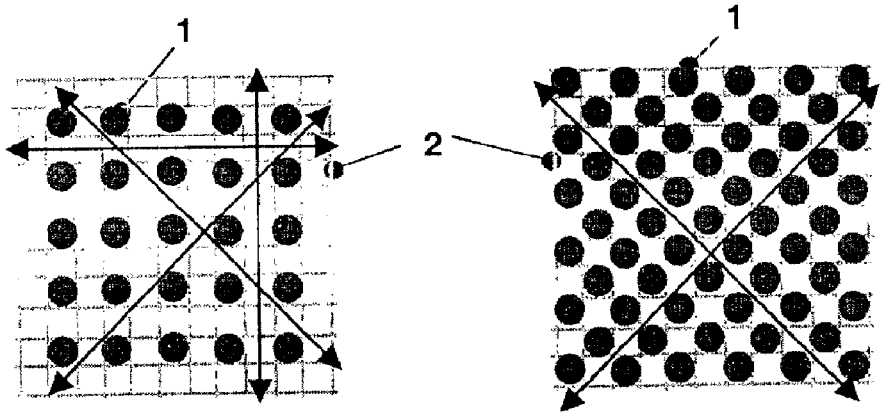
4a 4b

3-DIMENSIONAL MAT-SYSTEM FOR POSITIONING, STAGGERED ARRANGEMENT AND VARIATION OF AGGREGATE IN CEMENT-BONDED STRUCTURES

CROSS-REFERENCE AND PRIORITY CLAIM TO RELATED APPLICATIONS

This application is a continuation application of International application PCT/IB00/011369 filed Sep. 27, 2000, now abandoned, and published in German on Apr. 5, 2001 (publication No. WO 01/23685), claiming priority of Swiss patent application 1788/99 filed Sep. 27, 1999.

BRIEF SUMMARY OF THE INVENTION 3-dimensional mat systems with integrated aggregate (1) are the basis for a microreinforced high performance concrete. The material performance as high load capacity, durability, energy absorption, impact resistance, electrical and thermal conductivity, density against fluids, high plasticity and crack control can be adjusted precisely by variation of the mesh width and by positioning and variation of the type and size of aggregate (1). The composite material will be produced by slurry infiltration in a 3-dimensional mat system, performing as sieve and micro-reinforcement. The precise positioning of the aggregate (1) allows a defined regulation of the material stiffness in the tension and the compression zone of the member by variation of size and specific gravity of the aggregate. Consequently the deflection, the flow of internal forces and the crack propagation of the concrete member can be controlled as well as the adjustment of weight from extreme lightweight to heavyweight structures. The deformation of the 3-dimensional mat system in combination with a monolithic splicing of the mats allows a simplified sectional system (FIG. 5) or any other typical structural profile. The characteristics of the microreinforced, multifunctional material in combination with a simplified execution are the basis for cost effective long term behavior and they open a large spectrum of applications. (table 1.2)

Specification

The invention relates to a microreinforced high performance concrete for the manufacture of structural and impervious members following claim N°1. The structural system is a composite material consisting of a 3-dimensional reinforcing and sieving mat system bonded in concrete. The aggregate can be precisely positioned horizontally and vertically in the member by variation of the mesh width of the single layers (2). The sieving effect by the variation of the mesh width in vertical direction guarantees a positioning of aggregate by size.

System a: positioning of the aggregate (1) can be determined before fabrication of mat systems with integrated coarse aggregate. During the second step a slurry with fine aggregate will be infiltrated.

System b: the prefabricated 3-dimensional mat system contains no aggregate. The aggregate (1) will be positioned during the slurry infiltration by the sieving effect of the 3-dimensional mat system.

The material of the single layers (2) is variable, but preferably metallic or plastic. The optimization of cement bonded materials is guaranteed by the precise positioning of aggregate over the member cross section and by the adjustment of the desired material performance. The combination of the positioning and the variation of aggregate (1) with the load capacity of the 3-dimensional mat system (2) allow structural members with high performance in flexible rotation, abrasion resistance, impact resistance, durability, load capacity, ductility, crack control and fire resistance.

BACKGROUND OF THE INVENTION (STATE OF THE ART)

Conventional concrete members will be manufactured with a constant grain size distribution over the cross section of structural members (slabs, walls, girders etc.). The attempt of positioning of the aggregate (1) in different layers already fails during the compaction by vibration. The result is a random distribution of the aggregate (1) over the cross section and a large scattering of the material performance. A stress-strain curve of a loaded beam has in contradiction of theoretical assumptions no consistency of the cross sections. The strain curve of the compression zone and the tension zone are different (see FIG. 6). The strain in the tension zone of the member is larger than in the compression zone. Conventional concrete members have no positioning and variation of the aggregate size and therefore only a more or less constant stiffness (large stiffness) over the cross section. Consequently the members tend to crack by a small strain. The cracks of reinforced concrete members can only be minimized to w=0.20 mm. The minimum crack width of 0.20 mm doesn't satisfy the requirements of impervious overlays [Lit.1]. In addition reinforced concrete members have a required concrete cover of the reinforcement of at least 25 mm. Consequently the load cannot be taken by the overall cross section of the member and the dead load of the member increases.

ILLUSTRATION, LISTING OF FIGURES

FIG. 1.1 3-dimensional mat system with integrated aggregate (1) (perspective view) Space positioning and variation of aggregate sizes FIG. 1.2 similar to FIG. 1.1 with 3-dimensional interweaving (4) or other interconnection elements (3)

FIG. 2 3-dimensional mat system with variation of mesh width (perspective view) (aggregate positioning by sieving effect (sieve 1 to n) during slurry infiltration)

- sieve 1 enclosing mesh layers (2) for staggered arrangement and positioning of aggregate and performing as reinforcement for load and crack control.
- sieve 2 single layers (2) with small mesh width=template, positioning of displacement elements (=hollow elements)
- sieve n single layers (2) with small mesh width for fine aggregate FIG. 3 Structural system in prestressing bed with eccentric and center prestress. It performs by prestressing the single layers (2) of the 3-dimensional mat system.

FIG. 4 Positioning of the integrated aggregate (1), performing as displacement elements (i.e. hollow grains, plane view)

FIG. 5 Mat-elementation for sectional systems (perspective view)

Figure 6:
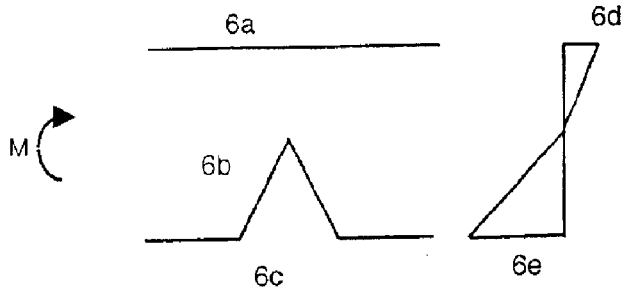

FIG. 6 Strain relation of a loaded beam

Figure 7:
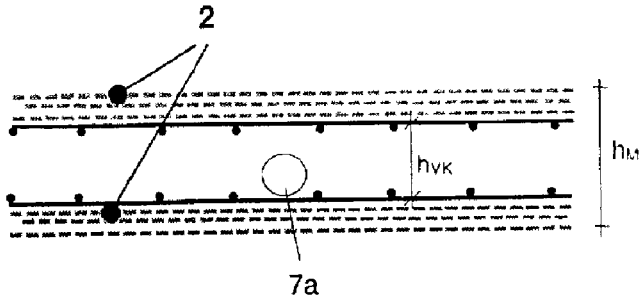

FIG. 7 Mat system with integrated cable channels

Figure 8:
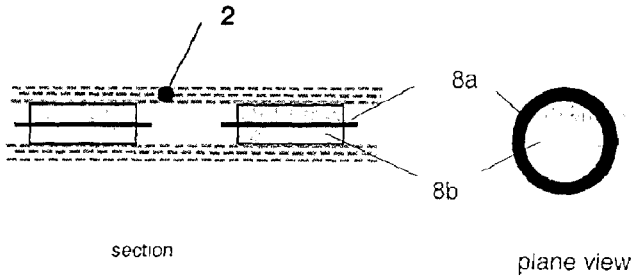

FIG. 8 Integrated discs with impervious rings

Figure 9:
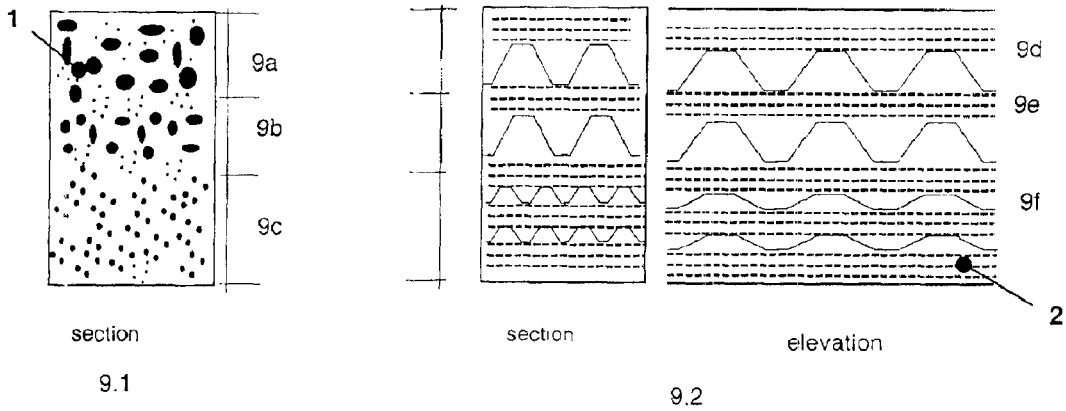

FIG. 9 Girder with single mesh layers (sieve)

Figure 10:
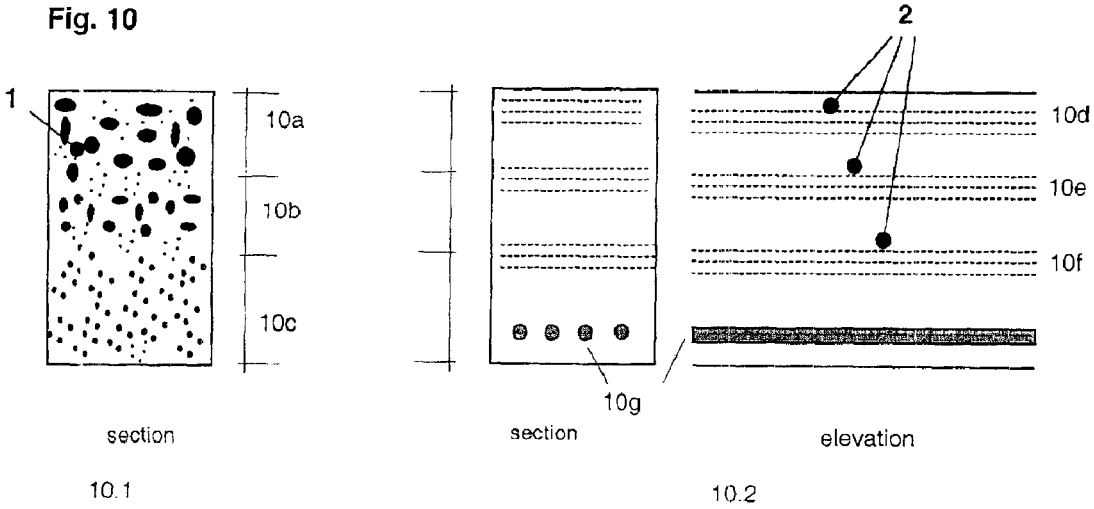

FIG. 10 Girder with single mesh layers (sieve)+rebar

Figure 11:
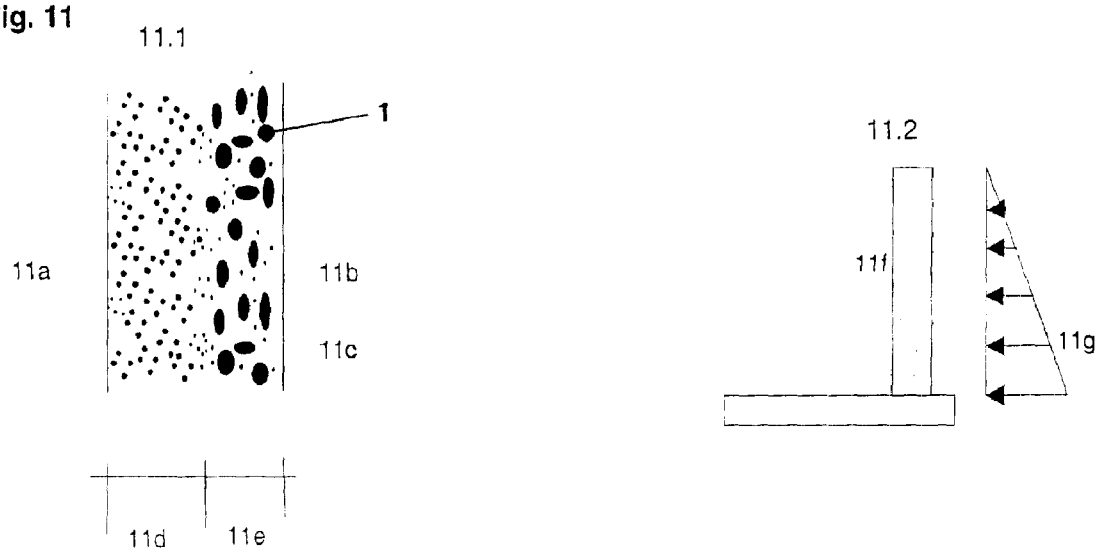

FIG. 11 Positioning of aggregate in wall members (section view)

Figure 12:
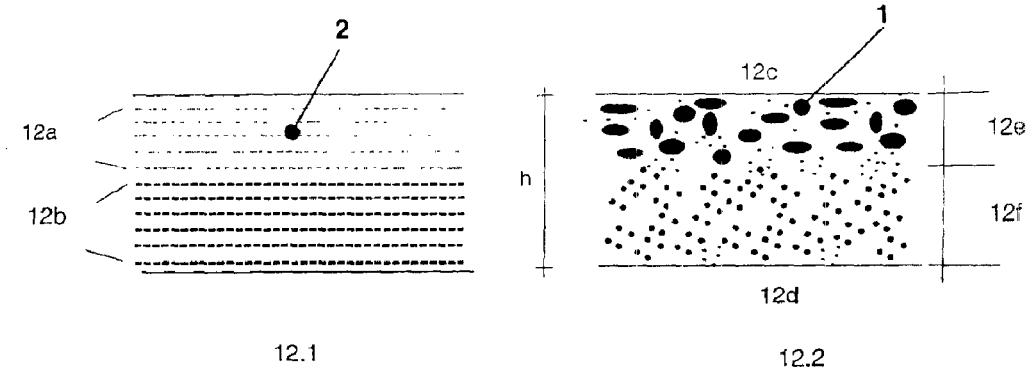

FIG. 12 Positioning of aggregate in plane areas (section view)

INTENTION OF THE INVENTION

The intention of the invention is the variation and precise positioning of the aggregate (1) over the cross section of a member in order to produce a defined grain size distribution, i.e. for stiffness control. A large stiffness in the compression zone of the member will be achieved by positioning coarse aggregate (1) and a small stiffness in the tension zone will be produced by crushed and fine aggregate (1). For example, for a high-strength concrete (100 MPa) the stiffness can be adjusted from 20,000 MPa (fine grain=2 mm) to 50,000 MPa (coarse grain=32 mm) by positioning the aggregate (1). The large stiffness in the compression zone of a member results in a better load dispersion and a higher load capacity up to the failure strain of a compression member. The small stiffness in the tension zone allows a maximization of the failure strain, so that crack propagation can be avoided even during large torsion, rotation and bending loads until failure. This effect ensures durability and density and consequently a long term behavior of the composite material. In addition the fine aggregate (1) improves the bonding between concrete and rebar. In general, high load capacity in combination with plasticity and crack minimization in a structural member can be achieved by variation of the material stiffness over the cross section.

The development of a specified 3-dimensional mat system, consisting of single layers (2) of micro meshes, is the foundation for positioning and variation of aggregate (1) either in the horizontal or in the vertical cross section. By the exact positioning of aggregate (1) in combination with a 3-dimensional mat system the desired material performance relating to high load capacity, high density, durability, ductility, impact resistance, torsion, rotation, crack control, thermal and electric conductivity, energy absorption etc. can be adjusted precisely. In addition the inconsistency of performance in conventional concrete can be reduced to a minimum.

The advantages of high performance concrete and of 3-dimensional mat systems, performing as microreinforcement and as a sieve, will be superpositioned. These advantages are described in a publication by the inventor [Lit.2].

DETAILED DESCRIPTION OF THE INVENTION i) Composition of the Mat System

See FIGS. 1 and 2

- single layers (2) enclose the aggregate (1)
- single layers (2) with small mesh width as template for the defined position of the aggregate (1)
- single layers (2) ensure the compression tension capacity of the member
- 3-dimensional tying or interweaving (3, 4) perform as fixation for the single layers (2) and ensure the shear capacity of the member (see FIG. 1)
- the thickness of the 3-dimensional mat system can be defined and adjusted precisely, i.e. for abrasive overlays $h_{mat}$=10 to 100 mm
- 3-dimensional mat system with integrated aggregate (1) allow in addition the integration of cable channels, heating systems etc. (see FIG. 7)

ii) Material of Mat System

The type and the strength capacity of the material can be composed arbitrarily (preferably high strength and normal strength steel)

- Multiple staggered arrangement of mat material with interconnecting elements
  - single layers (2) in expanded metal
  - single layers (2) in welded or woven meshes
- 3-dimensional set-up
  - Fabrication of a 3-dimensional mat system by interweaving without additional interconnecting elements iii) Aggregate General remark: the material stiffness can be adjusted by all different types of aggregate (1), as different types can be combined.

| | |
|---|---|
| Type of aggregate: | standard (coarse, stone chips, sand etc.<br>light- and heavyweight<br>hollow core (works as displacement core) |
| Spec. Gravity: | extends from extreme light-weight (hollow) to heavy-weight |
| Shape: | arbitrary (ball, disc, cubic etc.) |
| Size: | arbitrary (regulation of dead load and spacing of the single layers (2)) |
| Positioning: | arbitrary formation and positioning in the horizontal layer of prefabricated 3-dimensional mat system with integrated aggregate (1) (see. FIG. 4). Vertical positioning of aggregate (1) by sieving effect of the 3-dimensional mat system during slurry infiltration (see FIG. 2) |

Specific Gravity of Aggregate (1)

- aggregate (1) as hollow core, light-weight→minimization of member dead-load
- aggregate (1) as normal-weight→reduction of the fine particles and the shrinkage of the member, increasing of material stiffness
- aggregate (1) as heavy-weight→i.e. steel or lead for maximization of member dead load, radiation protection and sound insulation by the member Shape of Aggregate (1)

- arbitrary shape
- Round shape will fit into the meshes of the single layers (2)=template (FIG. 4)
- Discs and cubic shapes For impervious structures additional density rings might be added if needed, in order to minimize the soaking of the infiltrating liquid (see FIG. 8)

Size of Aggregate (1)

- Arbitrary adjustable (preferably≦50 mm)
- Performing as a spacer of the single layers (2)
- Regulation of stiffness of the member
- Regulation of the dead load of the member Positioning of the Aggregate (1)

a) Prefabricated 3-dimensional mat system with integrated aggregate (1) (FIG. 1.1).
   =aggregate (1) is positioned between the single layers (2) before slurry infiltration

- precise positioning of aggregate (1) in the horizontal layer regulates the load dispersion like a beam grid and the dead load of the member variants of positioning in the horizontal layer
  - i) multiaxial beam grid→maximal load capacity of the member (FIG. 4)
  - ii) diagonal beam grid→minimization of dead load of the member by using hollow aggregate (1) (grains), maximization of dead load of the member by using lead aggregate (1) (see FIG. 4)
- precise positioning of aggregate (1) in 3 dimensions controls the stiffness of the member as well as the load bearing capacity, the deflection, the energy absorption and the dead load b) Prefabricated 3-dimensional mat system without integrated aggregate (1) (FIG. 2)

=the aggregate (1) will be sieved into the defined position during slurry infiltration sieving and positioning of aggregate (1) by variation of the mesh width of the single layers (2)

EXAMPLES OF CONCRETE MEMBERS a) Beam Members a1) concrete beam, consisting of the 3-dimensional mat system example see FIG. 9 a2) concrete beam, consisting of the 3-dimensional mat system and additional conventional rebars example see FIG. 10 b) Wall Members with Staggered Arrangement and Variation of the Size of Aggregate (1)

advantage: high material stiffness by positioning coarse aggregate (1) in the compression zone of the member, high bearing load and abrasion resistance minimization of crack width by positioning fine aggregate (1) in the tension zone of the member crack propagation adjusted by mesh width of the single layers (2), cracks develop at each mesh node example see FIG. 11 c) Abrasive Resistant Overlays with Staggered Arrangement and Variation of the Size of Aggregate (1)

example: 3-dimensional mat system for filtration of aggregate (1), performing as sieve advantage: high material stiffness by positioning coarse aggregate (1) near the surface of the overlay (compression zone), results in a high bearing load capacity and high abrasion resistance low material stiffness by positioning fine aggregate (1) near the bottom part of the overlay (compression zone), results in a minimization of the crack propagation and in an increase of durability=long term behavior example see FIG. 11

ADVANTAGES OF THE DESCRIBED METHOD

Listing of advantages of the described method compared to the state of the art.

| Advantages of the 3-dimensional mat system for staggered arrangement, positioning and variation of aggregate |
|---|
| Technical advantages: |
| • 3-dimensional control of load bearing and deflection of cement bonded members by precise positioning of the 3-dimensional mat system and the aggregate (1) |
| • Precise positioning of the aggregate (1) in the horizontal layer (beam grid see FIG. 4) |
| • Precise positioning of the aggregate (1) in 3 dimensions over the cross section of the member (see FIG. 1.1) |
| • System without joints by monolithic splicing of the mats |
| • Minimization of the concrete embedment |
| => The complete height of the cross section can be taken into account for static analysis, |
| => Minimization of the member thickness |
| => No additional spacer for the single layers (2) necessary |
| => Cost reduction |
| • 3-dimensional load bearing capacity |

-continued

| Advantages of the 3-dimensional mat system for staggered arrangement, positioning and variation of aggregate |
|---|
| • High effectiveness because of maximum distance of single layers (2) to the neutral axis |
| • Precise alignment of single layers, performing as reinforcement |
| • 3-dimensional interconnection of the mat system increases the shear load capacity of the member |
| • steel volume fraction can be adjusted precisely between 0.5 and 15.0% of volume |
| • Installation of the 3-dimensional mat system in defined parts of the member, i.e. only near the member surface |
| • Large variety of mat systems possible i.e. with integrated heating wires, prestress of single layers (2), confinement of structural members |
| • Characteristics<br>Extremely ductile, high bearing load capacity, minimization of crack development, minimization of inconsistency in material performance by variation and positioning of aggregate (1), 3-dimensional structural performance of the mat system |
| • Crack width <<0.03 mm during service limit state (conventional concrete w ≧0.20 mm) |
| • Multifunctional composite material by multiple layer set-up => superimposing of a variety of characteristics by one material (i.e. sound protection, insulation, electric and thermal conductivity, impact resistance etc.) |
| Economic advantages: |
| • Cost reduction and optimization by variation of the aggregate (1) |
| • Minimization of the construction work by a simplified placing of the prefabricated 3-dimensional mat system |
| • monolithic continuous system with high load capacity => no cost intensive joints necessary |
| • multifunctional material, which covers a variety of performances => no cost intensive additional materials necessary |
| • integration of hollow aggregate (1) as displacement core |
| => minimization of dead weight |
| => minimization of cost of transport |
| => enlargement of precasted structural members = acceleration of the erection of the structure |
| => minimization of duration of the construction |
| • Simplified elementation |
| => sectional system with quality assurance, no specialists for the execution necessary |
| • no embodiment of the single layers (2) necessary => minimization of thickness => minimization of dead weight => small transporters and cranes |

3-dimensional Mat System as Prestressing Element

Using the Prefabricated Mat System for Prestressing of Concrete Members

The difference in existing methods is, that defined single layers of the 3-dimensional mat system can be prestressed especially in extremely thin concrete members. The prestressing allows an increase of the member span and crack-free structure.

Structural System

=Prestressing in a prestressing bed a) eccentric prestress by prestressing defined single layers (2) consisting of high strength or equivalent material (see FIG. 3.1)

b) center prestress by prestressing either all single layers (2) or defined layers by keeping the symmetry to the center axis (see FIG. 3.2)

Usability of the Invention (Application)

Restoration, retrofit and damp proofing of existing structures as well the production of new structures with long term behavior are important projects for the future. Besides the economic advantages the improved characteristics of the composite material, like high load bearing capacity, durability, energy absorption, impact resistance, electrical thermal conductivity, density against fluids, high plasticity and crack control open a large spectrum of applications.

Preferred applications of the composite material (mat system+concrete with positioning and variation of aggregate) are abrasive and impervious overlays, blast barriers, precast elements, arbitrary profiles and shapes. The utilization of the thermal conductivity of the 3-dimensional mat system ensures a heatable material. This heating effect can be activated in members or areas, which are supposed to be free of ice and snow. (see table 1.2)

A special monolithic splicing of the 3-dimensional mat system has been developed, which allows structures free of joints. In addition, the deformation of the 3-dimensional mat system in combination with a monolithic splicing of the mats are the foundation for a simplified sectional system (FIG. 5), consisting of standard-, angle- and edge-elements. This simplified system ensures an execution with constant high quality and does not require specialized workers.

In addition, precast members will be part of the application. Based on the flexibility of the 3-dimensional mat system the precast members can be produced in arbitrary shapes (tubes, cylindric tanks and any other typical structural profiles). The prestressing of high loaded thin members allow slim and crack free structures. In addition structures with high energy absorption such as blast barriers, earthquake resistant structures, safes and bunkers, can be created by defined spatial positioning of the aggregate (1).

The material characteristics open up a wide spread field of applications:

TABLE 1.2

Spectrum of applications of the 3-dimensional mat system with staggered arrangement and positioning of aggregate (1)

| Application |
|---|
| Overlays |
| Highway and airport pavements, bridge deck overlays, runways, coastal environment, stilling pools, settlement poinds, gas stations, industry floor slabs, loading areas etc. |
| Energy absorption (blast) |
| military shelters, safety rooms, safes, refuse bunkers, bullet-proof and blast barriers, plastic hinge connections, retrofit of existing structures etc. |
| Precast structures |
| tubes, thin facade plates, sacrifice formwork, structural profiles |
| Heatable areas |
| runways, ramps, bridges, car-wash, pipes, housing |
| Others |
| precast panels, any profile shapes, containers for liquids, tubes, chimneys, radiation absorber, tunnel shells, thin panels, confinement, prestressed and composite structures, sound insulation members etc. |

Literature

[Lit.1] Deutscher Ausschuß für Stahlbeton: DAfStb-Richtlinie für Umgang mit wassergefährdenden Stoffen, 1996 (Germany)

[Lit.2] Hauser, S.: DUCON ein innovativer Hochleistungsbeton, Beton-u. Stahlbetonbau, February +March 1999 (Germany)

List of references (abbreviations)

| No. | Content |
|---|---|
| 1 | Aggregate |
| 2 | Single layers of the 3-dimensional mat system |

-continued

List of references (abbreviations)

| No. | Content |
|---|---|
| 3 | Elements of fixation |
| 4 | 3-dimensional interweaving |
| 5 | High-strength steel |

Designation of figures

| Figure | Position | Content |
|---|---|---|
| 1.1 | — | |
| 1.2 | — | |
| 2 | 2a | Sieve 1 (large mesh width) |
| | 2b | Sieve 2 (medium mesh width) |
| | 2c | Sieve n (small mesh width) |
| 3 | 3.1 | Eccentric prestressing |
| | 3a | Prestressing anchor |
| | 3.2 | Center prestressing |
| 4 | A | Defined multiple axial load dispersion (main axis + diagonals) |
| | B | Maximum utilization of space (diagonal load dispersion) |
| 5 | 5a | Angle-element |
| | 5b | Edge-element |
| | 5c | Standard-element |
| 6 | 6a | Compression zone |
| | 6b | Crack |
| | 6c | Tension zone |
| | 6d | Elongation under compression |
| | 6e | Elongation under tension |
| 7 | 7a | i.e. cable channel, power heating etc. |
| 8 | 8a | Perimeter lips |
| | 8b | Disc with perimeter lips |
| 9 | 9.1 | Staggered arrangement of the aggregate size over the cross section |
| | 9a | High concrete stiffness ($E_c$ > 50,000 N/mm$^2$) |
| | 9b | Medium concrete stiffness (30,000 < $E_c$ < 50,000 N/mm$^2$) |
| | 9c | Small concrete stiffness ($E_c$ < 30,000 N/mm$^2$) |
| | 9.2 | Staggered arrangement and variation of the single layers over the cross section |
| | 9d | i.e. large mesh width (w = 16 mm) |
| | 9e | Medium mesh width (w = 8 mm) |
| | 9f | Small mesh width (w < 4 mm) |
| 10 | 10.1 | Staggered arrangement and variation of the aggregate size over the cross section |
| | 10a | High concrete stiffness ($E_c$ > 50,000 N/mm$^2$) |
| | 10b | Medium concrete stiffness (30,000 < $E_c$ < 50,000 N/mm$^2$) |
| | 10c | Small concrete stiffness ($E_c$ < 30,000 N/mm$^2$) |
| | 10.2 | Staggered arrangement and variation of the single mesh layers over the cross section |
| | 10d | i.e. large mesh width (w = 16 mm) |
| | 10e | Medium mesh width (w = 8 mm) |
| | 10f | Small mesh width (w < 4 mm) |
| | 10g | Steel reinforcement, rebars |
| 11 | 11.1 | Cross section of a wall |
| | 11a | Tension zone |
| | 11b | Compression zone |
| | 11c | Slurry infiltration by the side with large aggregate |
| | 11d | Small stiffness |
| | 11e | Large stiffness |
| | 11.2 | i.e. horizontally loaded basement wall |
| | 11f | Exposed concrete quality (interior) |
| | 11g | Load (exterior) |
| 12 | 12.1 | Positioning of the single layers over the cross section of a slab |
| | 12a | Large mesh width |
| | 12b | Small mesh width |
| | 12.2 | Staggered arrangement and variation of aggregate over the cross section of a slab |
| | 12c | Compression zone |

-continued

Designation of figures

| Figure | Position | Content |
|---|---|---|
| | 12d | Tension zone |
| | 12e | Part of member with large stiffness |
| | 12f | Part of member with small stiffness |
| | 12.2 | Staggered arrangement and variation of aggregate over the cross section of a slab |
| | 12f | Exposed concrete quality (interior) |
| | 12g | Load (exterior) |

I claim:

1. A method of producing a microreinforced concrete member for erection of loaded and/or impervious structures, the method comprising the steps of:

a) arranging at least three mesh layers on top one another and securing the at least three mesh layers spaced apart relative to one another to form a three-dimensional mat system having a mesh arrangement that is preselected based on desired performance properties of the concrete member such that a mesh width of the mesh arrangement of the three-dimensional mat system decreases at least in a direction perpendicular to a face of the at least three mesh layers;

b) subsequently, infiltrating a slurry containing first aggregate in an infiltration direction from a largest mesh width to a smallest mesh width into the three-dimensional mat system and positioning the first aggregate according to decreasing aggregate size in said infiltration direction at preselected locations within the three-dimensional mat system in accordance with the desired performance properties, wherein the preselected locations are determined by the mesh arrangement.

2. The method according to claim 1, wherein in the step a) a second aggregate of a defined size and/or defined weight is positioned at predefined locations in the three-dimensional mat system.

3. The method according to claim 2, wherein portions of the second aggregate are positioned precisely in intermediate spaces between the mesh layers and act as a spacer while providing a stiffness control in the concrete member based on a variation of the defined size and/or defined weight in the intermediate spaces.

4. The method according to claim 2, wherein in the step a) a thickness of the three-dimensional mat system is adjusted by performing at least one of:

varying a number of the mesh layers;

varying the interconnecting elements;

varying interweaving of the mesh layers; and selecting the size of the second aggregate.

5. The method according to claim 2, further comprising the step of adjusting a weight of the concrete member for a preselected volume of the concrete member by selecting in the step b) the aggregate size and specific gravity of the first aggregate and selecting the defined weight of the second aggregate.

6. The method according to claim 1, further comprising the step of selecting the mesh layers from the group consisting of expanded metal, knotted metal networks, welded metal, and interwoven metal.

7. The method according to claim 1, wherein, in the step b), the aggregate size and a specific gravity of the first aggregate are selected such that a dead weight of the concrete member is adjusted precisely in accordance with the preselected locations.

8. The method according to claim 1, wherein, in the step a), the mesh layers are interconnected.

9. The method according to claim 8, wherein interconnecting elements are provided for interconnecting the mesh layers or the mesh layers are interconnected by interweaving.

10. The method according to claim 1, wherein in the step a) a thickness of the three-dimensional mat system is adjusted by performing at least one of:

varying a number of the mesh layers;

varying the interconnecting elements; and varying interweaving, of the mesh layers.

11. The method according to claim 1, further comprising the step of adjusting a steel volume fraction of the mesh layers within the concrete member within a range of 0.5% to 12% of a volume of the concrete member by performing at least one of:

varying in the step a) a number of the mesh layers;

selecting in the step a) a wire diameter of the mesh layers; and selecting in the step a) the mesh width.

12. The method according to claim 11, wherein the wire diameter is 0.2 mm to 2 mm.

13. The method according to claim 1, wherein, in the step a), the mesh width is from 3 mm to 50 mm.

14. The method according to claim 1, wherein, in the step a), the mesh layers consist of different types of materials.

15. The method according to claim 1, wherein, in the step a), the meshes of the mesh layers are shaped differently.

16. The method according to claim 1, wherein, in the step a), the mesh layers consist of different types of materials and the meshes of the mesh layers are shaped differently.

17. The method according to claim 1, further comprising the step of prestressing the mesh layers in a prestressing bed.

18. The method according to claim 1, further comprising the step of selecting a material of the mesh layers from the group consisting of metal and plastic.

19. The method according to claim 1, wherein the mesh width of a lowermost one of the at least three mesh layers is <4 mm, the mesh width of a centrally arranged one of the at least three mesh layers is 8 mm, and the mesh width of the uppermost one of the at least three mesh layers is 16 mm.

20. The method according to claim 1, further comprising the step of adjusting a weight of the concrete member for a preselected volume of the concrete member by selecting in the step b) the aggregate size and specific gravity of the first aggregate.

21. The method according to claim 2, further comprising the step of adjusting a weight of the concrete member for a preselected volume of the concrete member by selecting in the step b) the aggregate size and specific gravity of the first aggregate and selecting the defined weight of the second aggregate.

* * * * *